US005956868A

United States Patent [19]

Stevens et al.

[11] Patent Number: 5,956,868

[45] **Date of Patent: *Sep. 28, 1999**

[54] DANCE SHOE WITH ELASTIC MIDSECTION

[75] Inventors: Dennis Stevens, Waldwick, N.J.; John Terlizzi, New Market, N.H.

[73] Assignee: Ballet Makers, Inc., Totowa, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/899,076

[22] Filed: Jul. 23, 1997

[51] Int. Cl.[6] ..... A43B 5/12; A43B 3/26

[52] U.S. Cl. ..... 36/8.3; 36/97

[58] Field of Search ..... 36/8.3, 135, 7.5, 36/97, 7.6

[56] References Cited

U.S. PATENT DOCUMENTS

| | | |
|---|---|---|
| 1,204,796 | 11/1916 | Lockwood . |
| 2,252,315 | 8/1941 | Doree . |
| 3,609,888 | 10/1971 | Rickman . |

FOREIGN PATENT DOCUMENTS

| | | |
|---|---|---|
| 92195 | 10/1922 | Austria . |
| 1077711 | 5/1980 | Canada . |
| 1266620 | 6/1961 | France . |
| 597644 | 1/1933 | Germany . |
| 168702 | 7/1934 | Switzerland . |
| 12812 | of 1905 | United Kingdom . |

*Primary Examiner*—Ted Kavanaugh

*Attorney, Agent, or Firm*—Ostrolenk, Faber, Gerb & Soffen, LLP

[57] ABSTRACT

A shoe primarily for dance including separate front and rear portions connected at their respective undersides by a narrow width elastic strip extending between the opposing edges of the shoe portions. A strap toward the top of the uppers connects the front and rear portions also. A sole beneath the front portion and a heel beneath the rear portion.

10 Claims, 2 Drawing Sheets

DANCE SHOE WITH ELASTIC MIDSECTION

BACKGROUND OF THE INVENTION

The present invention concerns a shoe primarily for dance that is simple in construction, easy to manufacture and has an elastic connection between the front portion of the shoe, which extends beneath the toes and up to at least near the arch, and the rear portion of the shoe which extends at least from near the rear of the arch and under the heel. The separated front and rear portions of the shoe are connected by a shank. Shanks of elastic material are disclosed in the art.

U.S. Pat. No. 2,362,010 shows a shoe with separated front and rear portions connected together, but without any elasticity in the part connecting them.

U.S. Pat. Nos. 4,554,749 and 2,252,315 show shoes with separated front and rear portions connected by an elastic material, and there is an elastic shank between the completely separated front and rear portions. An elastic material, expandable shank is also shown in U.S. Pat. No. 4,944,099, with an elastic connecting portion between the front and rear portions of the shoes, which would include a shank, can be seen in French Patent No. 1,266,620.

SUMMARY OF THE INVENTION

None of the prior art shoes has a simple front to rear connection beneath the wearer's foot that is so narrow in its width across the underside of the shoe and the shoe may be so open at its sides as to suggest to a viewer of the shoe from almost any direction, except from directly below, that the shoe has separate front and rear portions that appear to be completely unconnected. Further, a narrower elastic strip between the front and rear portions even provides greater lateral flexibility than would a wider strip that extends across the width of the front and rear edges of the rear and front portions of the shoe, respectively.

It is an object of the invention to provide a dance shoe with separate front and rear portions that are held together by an elastic material connection strip.

Another object of the invention is to provide such a shoe that appears attractive and wherein the elastic connection appears less visible.

Another object is to provide such a shoe where the mid-region of the bottom of the foot is essentially uncovered in fact and to the view of others.

Another object of the invention is to provide such a shoe which provides adjustability in length so that it is useable for various size feet.

These and other objects of the invention will become apparent from the following description of the invention considered in conjunction with the accompanying drawings.

DETAILED DESCRIPTION OF A PREFERRED EMBODIMENT

Figure 1:
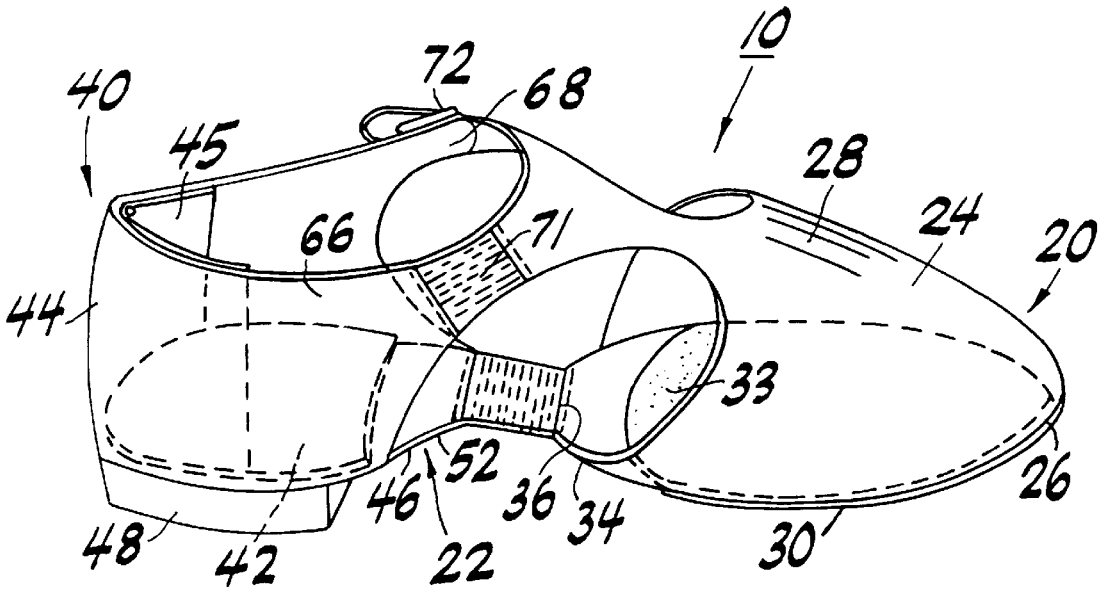
FIG. 1 is a side, top, perspective view of a shoe according to the invention.
Figure 2:
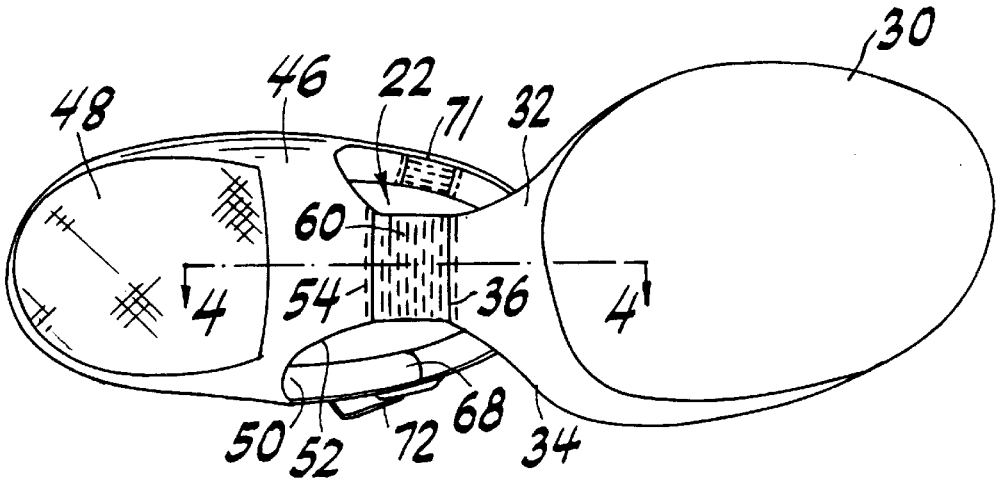
FIG. 2 is a bottom view thereof.
Figure 3:
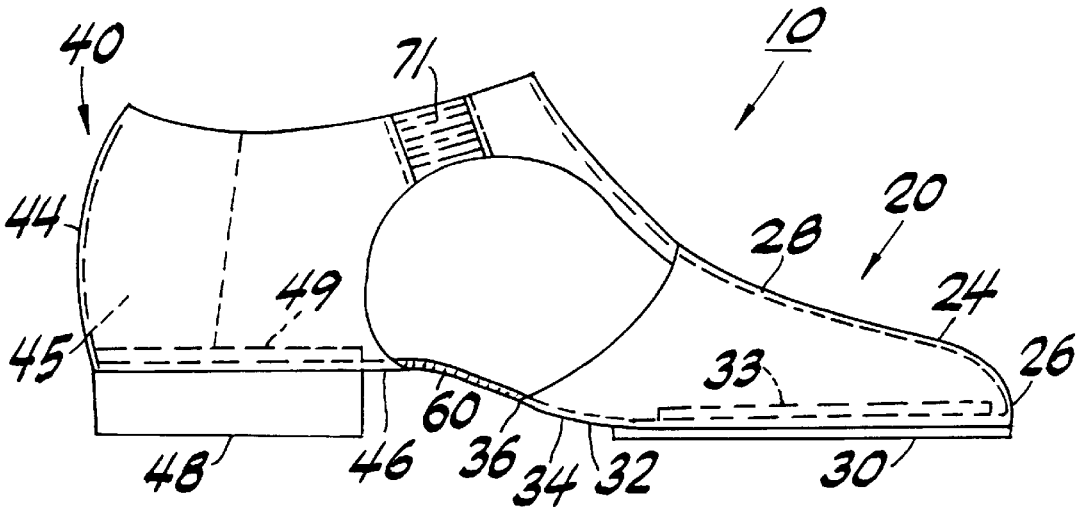
FIG. 3 is a side view thereof.

The shoe 10 of the present invention includes a front portion 20 and a rear portion 40 which are separated from each other at a gap 22 between them. The gap 22 is generally under the arch of the foot, that is generally rear of the metatarsal region and generally forward of the front end of the heel of the wearer's foot. The shoe 10 is primarily useful as a dance shoe since the front and rear portions 20 and 40 are so flexibly attached to each other, and there is so large an open space gap between the portions that use of the shoe for street use or athletic use is likely undesirable. The shoe 10 fits over the entire foot.

The front portion 20 of the shoe includes a shoe upper 24 which has a forward end 26 that wraps over the wearer's toes and has a top 28 side that extends rearwardly and over the top of the foot past the toes for preventing the front portion of the shoe from falling off the foot. Although the shoe upper 24 is shown as closed over the toes, other shoe upper designs, with openings at the front or the side of the upper, as with a sandal front design, may be used, so long as the shoe front portion 20 will stay on the wearer's toes. The shoe upper 24 is comprised of a double layer of leather, which is sewn at its margins to define the shoe upper. The two layers 25 and 27 can be seen at the bottom of the front upper 24 in FIG. 4.

Beneath the underside 32 of the shoe front upper 24 at the front of the shoe, there is attached a sole 30 which contacts the ground. There may be appropriate padding layers 33, etc. between the sole 30 and the inside of the shoe at the wearer's foot, as is conventional in shoes.

The front underside 32 of the shoe front upper 24 wraps under the wearer's foot and has a rear side edge 34 which tapers narrower generally toward the middle of the shoe to the narrowed general middle portion 36 of the rear edge. At the narrowed region 36, an elastic material shank strip 60 is attached as described below.

The rear shoe portion 40 includes the rear shoe upper 42, which includes the upstanding rear end wall 44 that extends up behind the wearer's heel and extends forwardly wrapping partly around the rear of the foot. Like the front shoe portion, the rear shoe portion is comprised of two overlying layers of leather which are sewn together at their edge margins. A stiffening heel counter and rear panel is attached to the rear end wall 44 inside the rear shoe upper. The rear shoe upper 42 wraps under the wearer's foot defining the rear underside 46 which extends beneath the wearer's heel.

A heel 48 is disposed beneath the rear underside 46. It may be the same height as or slightly taller than the sole 30, as a designer may wish. That is the part of the rear shoe portion 40 that contacts the ground. A heel pad 49 may be placed in the shoe beneath the wearer's foot.

The forward edge 50 of the rear underside 46 tapers narrower at 52 toward the middle region 54 of the front edge of the rear underside to receive the elastic strip 60. Although the rear and front edges 36 and 54 of the front and rear undersides 32, 46 are shown as tapering to narrowed widths, this shaping of the opposing edges is not required, and they may be blunt or flat. The tapered shaping of those edges gives the shoe a possible more attractive appearance.

The front and rear portions 20 and 40 of the shoe are positioned to normally provide a gap 22 between the rear edge 34, 36 of the front underside and the front edge 52, 54 of the rear underside 46. That gap is intended to be adjustable in length, which enables free movement and twisting of the foot, and may enable the shoe to be placed on the foot by merely pulling its portions apart and allowing them to be drawn elastically together.

A significant feature of the shoe is the elastic material, resilient strip shank 60 which extends between the narrowed middle 36 of the rear edge of the front underside 32 and the narrowed middle region 54 of the front edge of the rear underside 46. This connects the front and rear portions 20, 40 together, and the connection is generally at the middle of the front and rear portions across the shoe. The elastic strip is a flat strip of conventional elastic material, with sufficient strength to draw the shoe portions 20 and 40 toward each other to hold the shoe on the foot and to resist the shoe portions separating so that the shoe would fall off the foot when the shoe is used for dancing or walking, yet not so unyielding that excessive pressure is applied to the wearer's foot when the shoe is worn which might cause discomfort and the feeling that the shoe is ill fitting.

The length of the elastic strip 60 is selected so as to permit the rear edge 34, 36 of the front underside 32 and the front edge 52, 54 of the rear underside 46 to have an initial separated position which would define a particular standard size for the shoe and a length to permit the desired degree of stretching of the elastic strip.

The elastic strip 60 may be coated with a protective layer, e.g., leather or a rubberized coating, possibly of the same color as the shoe, or suggesting a skin tone so as to appear invisible, as a particular designer selects.

The elastic strip shank 60 is relatively narrow in width, as compared with the widths of the undersides 32 and 46 of the front and rear portions, for several reasons. First, it permits free relative movement of the front and rear portions around all three mutually perpendicular axes, if desired, and enables unencumbered movement of the foot wearing the shoe. Secondly, because the elastic strip is so narrow relative to the width of the shoe, and the elastic strip is beneath the wearer's foot at the undersides of the front and rear portions of the shoe, the elastic strip is virtually invisible, giving the shoe an open appearance, which may be attractive for a particular use.

Figure 4:
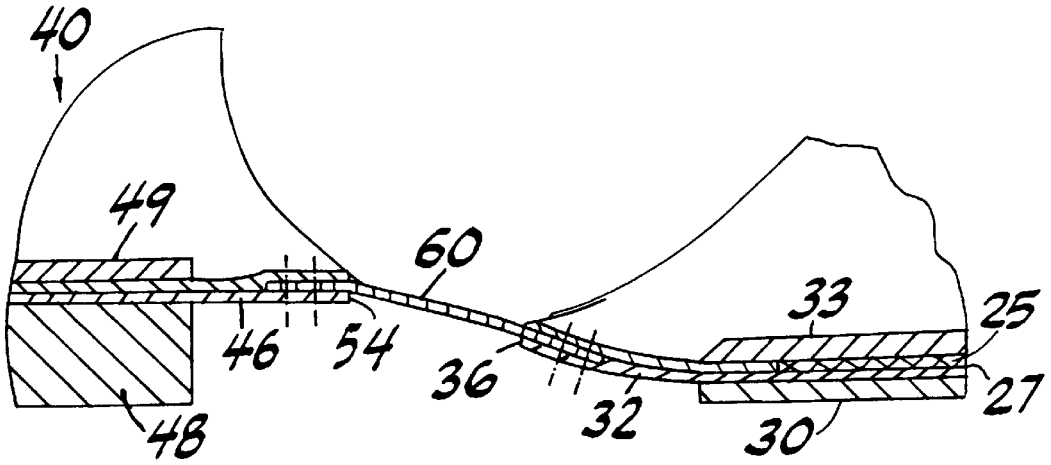
FIG. 4 is a cross-section along the line 4—4 in FIG. 2 of the middle region of the shoe.

As noted above, the material of the shoe upper is a double layer, sewn at its margins to define a single layer shoe upper. The elastic strip 60 is fastened at the opposing edges 36 and 54 of the shoe upper portions and the strip is held between the double layers, where it is sewn in place, as seen in FIG. 4.

In addition to being attached beneath the foot between the undersides of the shoe portions, the shoe upper front and rear portions 20, 28 and 40, 44 are connected by a strap 66 which extends between the upper portions 28 and 44 at one side of the foot and by the strap 68 that extends between the upper portions at the other side of the foot. The straps 66, 68 may pass by or slightly beneath the ankle of the foot or might pass the side of the foot, for example. An elastic material strip 71 is included in the strap 66 so that the shoe will yield as the wearer moves. An openable, securable buckle 72 or other mode of attachment is provided at least one of the straps 68 so that the shoe can easily be removed or placed on the foot. However, due to the stretchability of the elastic strips 60 and possibly 71 and due to the openness of the middle region of the shoe, the shoe might be placed on the foot without opening the buckle 72. Further, the particular strapping between the portions of the upper is not required. Alternate securement may be provided, so long as it is sufficient to hold the front and rear portions 20 and 40 together so that the shoe will not fall off the foot.

One of the benefits of the simplicity of this shoe design is that the shoe upper portions 20 and 40 may be formed from a single blank of shoe upper material, particularly soft leather, and the straps 66 and 68 are integrated in that blank. That blank may be of a double layer, as described above. In order to form the front and rear portions 20, 40, the shoe upper portions 24 and 42 of the blank are folded and wrapped under to define the undersides 32 and 46 of the front and rear portions. However, it is not required to make the shoe upper portions of a single blank. Further, the undersides 32 and 46 need not be folded under material of the uppers of the respective portions of the shoe. The undersides might not be integral with their respective uppers, and can be separate later attached together elements. A benefit of the invention is the ease with which almost the entire shoe can be formed of a single blank, except for the soles and the elastic strips, but it is not required that it be formed of a single blank.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A shoe for dance comprising:

a split-soled dance shoe construction for wearing as the primary protection of the dancer's foot, the shoe construction comprising:

a front portion for covering at least the toes and the upper front portion of a dancer's foot and having a front underside;

a rear portion for covering at least the heel and having a rear underside;

the front underside having a rear edge facing the rear portion and the rear underside having a front edge facing the front portion, wherein the rear and front edges of the front and rear undersides, respectively, are separated for uncovering to the view of others the mid-region of the bottom of the dancer's foot;

securing means above the front and rear undersides of the shoe for connecting the front and rear portions of the shoe in a manner for holding the shoe from slipping off the dancer's foot wherein the front and rear portions are connected over at least a central portion of the top of the foot; and only one single, narrow elastic material strip extending between the front and rear undersides of the shoe and connecting the front and rear undersides of the shoe together resiliently, the single narrow elastic strip being attached centrally to the front and rear undersides, and so that the front and rear undersides establish an initial position separated from each other, the elastic material being such as to permit the front and rear undersides to further separate slightly as desired, the elastic material strip having a width that is substantially narrower than the width of the foot between the rear edge of the front underside and the front edge of the rear underside of the shoe, the narrow strip giving great flexibility to relative movement of the front and rear undersides around all three mutually perpendicular axes, and permitting access to and view of the mid-region of the bottom of the foot between the front and rear undersides of the shoe except at the relatively narrower elastic strip.

2. The shoe of claim 1, further comprising a front outer sole beneath the front underside of the shoe for contacting the ground; and a rear heel beneath the rear underside of the shoe for contacting the ground.

3. The shoe of claim 1, wherein the securing means comprises a strap for being wrapped around the top side of the foot generally at the ankle.

4. The shoe of claim 3, further comprising means for attaching the strap around the foot.

5. The shoe of claim 1, where the front portion of the shoe is shaped for wrapping over at least some of the toes of the foot for defining a front end of the shoe, and the rear portion of the shoe is shaped at least for wrapping around the rear of the foot above the heel and for defining the rear end of the shoe.

6. The shoe of claim 1, wherein the elastic strip projects out of the rear edge of the front underside and the front edge of the rear underside of the shoe.

7. The shoe of claim 6, wherein the rear edge of the front underside of the shoe and the front edge of the rear underside of the shoe have respective middles across the width of the shoe; and the elastic strip extends from the front and rear edges at the respective middles.

8. The shoe of claim 7, wherein the rear edge of the front underside has a shape that tapers narrower in width to approximately the width of the elastic strip at the rear edge, and the front edge of the rear underside has a shape that tapers narrower generally in width to approximately the width of the elastic strip at the front edge.

9. The shoe of claim 6, wherein the rear edge of the front underside has a shape that tapers narrower in width to approximately the width of the elastic strip at the rear edge, and the front edge of the rear underside has a shape that tapers narrower generally in width to approximately the width of the elastic strip at the front edge.

10. In a shoe having a front portion covering at least the toes and the front portion of a wearer's foot and having a front underside, a rear portion covering at least the heel and having a rear underside, the front underside having a rear edge facing the rear portion and the rear underside having a front edge facing the front portion, wherein the rear and front edges of the front and rear undersides, respectively, are separated, securing means above the front and rear undersides of the shoe for connecting the front and rear portions of the shoe in a manner for holding the shoe from slipping off the foot, the front and rear portions being connected resiliently over at least a central portion of the top of the foot, the improvement comprising:

a dance shoe in which the rear and front edges of the front and rear undersides, respectively, are separated to uncover to the view of others the mid-region of the bottom of the foot, the dance shoe having only one single, narrow elastic material strip extending between the front and rear undersides of the shoe, the single narrow elastic strip being attached centrally to the front and rear undersides, and so that the front and rear undersides establish an initial position separated from each other, the elastic material being such as to permit the front and rear undersides to further separate slightly as desired, the elastic strip having a width that is substantially narrower than the width of the dancer's foot between the rear edge of the front underside and the front edge of the rear underside of the shoe, the narrow strip giving great flexibility to relative movement of the front and rear undersides around all three mutually perpendicular axes, and permitting access to and view of the mid-region of the bottom of the foot, by others viewing a dancer wearing the dance shoe, between the front and rear undersides of the shoe except at the relatively narrower elastic strip.

* * * * *